US009938056B2

(12) United States Patent
Inaba et al.

(10) Patent No.: US 9,938,056 B2
(45) Date of Patent: Apr. 10, 2018

(54) PACKAGE

(71) Applicant: TOPPAN PRINTING CO., LTD., Tokyo (JP)

(72) Inventors: Kazuhiko Inaba, Tokyo (JP); Shunsuke Yajima, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 18 days.

(21) Appl. No.: 15/074,729

(22) Filed: Mar. 18, 2016

(65) Prior Publication Data

US 2016/0200490 A1 Jul. 14, 2016

Related U.S. Application Data

(63) Continuation of application No. PCT/JP2014/076355, filed on Oct. 2, 2014.

(30) Foreign Application Priority Data

Feb. 12, 2014 (JP) ..... 2014-024787

(51) Int. Cl.
*B65D 51/16* (2006.01)

(52) U.S. Cl.
CPC ..... *B65D 51/1666* (2013.01); *B65D 51/1638* (2013.01)

(58) Field of Classification Search
CPC ..... B65D 51/1666; B65D 2581/3445; B65D 51/1633; B65D 51/1638; B65D 51/1644; B65D 77/225

(Continued)

(56) References Cited

U.S. PATENT DOCUMENTS 4,834,247 A * 5/1989 Oshima ..... B65D 75/12 219/734
6,660,983 B2 * 12/2003 Monforton ..... B65D 75/5855 219/727

(Continued)

FOREIGN PATENT DOCUMENTS

JP 01-069773 U 5/1989
JP H01-069773 U 5/1989

(Continued)

OTHER PUBLICATIONS

Office Communication issued in Taiwan Patent Application No. 103143196 dated Feb. 18, 2016.

(Continued)

*Primary Examiner* — Shawn M Braden
(74) *Attorney, Agent, or Firm* — Foley & Lardner, LLP

(57) ABSTRACT

A package has a seal portion that includes steam passage portions for externally releasing steam from inside the tray. The steam passage portion has an inner edge in which the portions configuring one side and the other side relative to the tip are curved and extended nearing each other toward the tip. The steam passage portion has an outer edge in a curved shape with a pointed tip, the shape being similar to that of the inner edge. The steam passage portion has a merging portion located between the tip of the outer edge and the tip of the inner edge, and a non-merging portion located between the merging portion and a common portion. The non-merging portion has a width narrowed from the common portion toward the merging portion.

6 Claims, 4 Drawing Sheets

(58) Field of Classification Search
USPC ..... 220/367.1
See application file for complete search history.

(56) References Cited

U.S. PATENT DOCUMENTS

| | | | | |
|---|---|---|---|---|
| 8,153,216 | B2 * | 4/2012 | Fenn-Barrababeta | B65B 51/14 220/359.1 |
| 2009/0123619 | A1 * | 5/2009 | Narine | A21D 2/16 426/330.6 |
| 2014/0339105 | A1 * | 11/2014 | Czarny | B65D 81/266 206/204 |

FOREIGN PATENT DOCUMENTS

| | | | |
|---|---|---|---|
| JP | 08-276966 | A | 10/1996 |
| JP | 08-025583 | A | 2/2008 |
| WO | WO-2013/100058 | A1 | 7/2013 |

OTHER PUBLICATIONS

International Search Report issued in International Patent Application No. PCT/JP2014/076355, dated Dec. 16, 2014.

* cited by examiner

PACKAGE

CROSS-REFERENCE TO RELATED PATENT APPLICATIONS

This application is a continuation application filed under 35 U.S.C. § 111(a) claiming the benefit under 35 U.S.C. § § 120 and 365(c) of PCT International Application No. PCT/JP2014/076355 filed on Oct. 2, 2014, which is based upon and claims the benefit of priority of Japanese Application No. 2014-024787, filed on Feb. 12, 2014, the entire contents of them all are hereby incorporated by reference.

TECHNICAL FIELD

The present invention relates to a package which includes a tray and a sheet sealed to the tray.

BACKGROUND

A package as one example includes a tray for occupancy by an object to be heated, such as food. The tray has a top face which is sealed to a sheet to hermetically close an opening of the tray. A user can heat such a package using a heating means, such as a microwave oven, to cook food, for example, that is an object to be heated.

When the object to be heated generates steam with the heating of the package, the inner pressure of the tray increases to push up the sheet due to inflation. Then, when the inner pressure has increased to an extent that the sheet can no longer endure the inner pressure, without the tray's being deflated, the sheet may be broken due to the excessive inflation. For this reason, a package whose inner pressure increases due to heating is provided with a steam passage portion to externally release the steam from inside the tray. The steam passage portion is formed in a part of a seal portion where the sheet is sealed to the tray.

PTL 1 discloses an example of such a package. The package includes a seal portion which is partially provided with a steam passage portion (a protrusion) protruded from an outer edge of the tray toward an opening. Since the steam passage portion is in a shape with a pointed tip, the inner pressure of the tray is easily concentrated on the steam passage portion, compared to a linearly-shaped portion of the seal portion. Therefore, when the inner pressure of the tray has increased with the heating of the package, the steam passage portion will peel off earlier than other parts of the seal portion. As a result, a steam passage is formed in the peel-off portion so that the interior and the exterior of the tray can communicate with each other. Thus, the steam inside the tray is externally released through the steam passage, and unlikely to create a state where the sheet is excessively pushed up due to inflation.

CITATION LIST

Patent Literature

PTL 1: JP-B-H08-025583

SUMMARY OF THE INVENTION

Technical Problem

The inner pressure of the tray accompanying the heating of a package has a magnitude that can vary due to various factors. A main factor is the type of the object to be heated.

When a tray accommodates an object to be heated that generates much steam, the sheet is likely to be excessively pushed up due to inflation caused by the heating.

On the other hand, to enhance the universality, it is preferable that the steam can be released without allowing the sheet to be excessively pushed up due to inflation, when such an object to be heated is accommodated in the tray. To this end, the steam inside a tray is needed to be more easily released than in a package based on conventional art. The package of PTL 1 is not based on the study of releasing steam from such a viewpoint and thus has room for improvement.

The present invention has as its object to provide a package which is less likely to create a state where the sheet is excessively pushed up due to inflation when heated.

Solution to Problem

A mode of the present package according to the present invention includes: a tray having an opening and a top face extended around the opening; and a sheet sealed to the top face to hermetically close the opening. In the package, the sheet is sealed to the top face to form a seal portion that has a common portion extended along an outer shape of the tray and a steam passage portion externally releasing steam from inside the tray; the steam passage portion has an inner edge protruded from an inner edge of the common portion toward the opening so as to have an angled shape with a pointed tip, the inner edge of the steam passage portion having a portion configuring one side relative to the tip and a portion configuring another side relative to the tip, the both portions configuring the sides being curved and extended nearing each other toward the tip; the steam passage portion has an outer edge in a curved shape with a pointed tip, the shape being similar to that of the inner edge of the steam passage portion; and the steam passage portion includes a merging portion corresponding to a peak of the angled shape and located between the tip of the outer edge and the tip of the inner edge, and a non-merging portion located between the merging portion and the common portion, the non-merging portion having a width narrowed from the common portion toward the merging portion.

DESCRIPTION OF REPRESENTATIVE EMBODIMENTS

Figure 1:
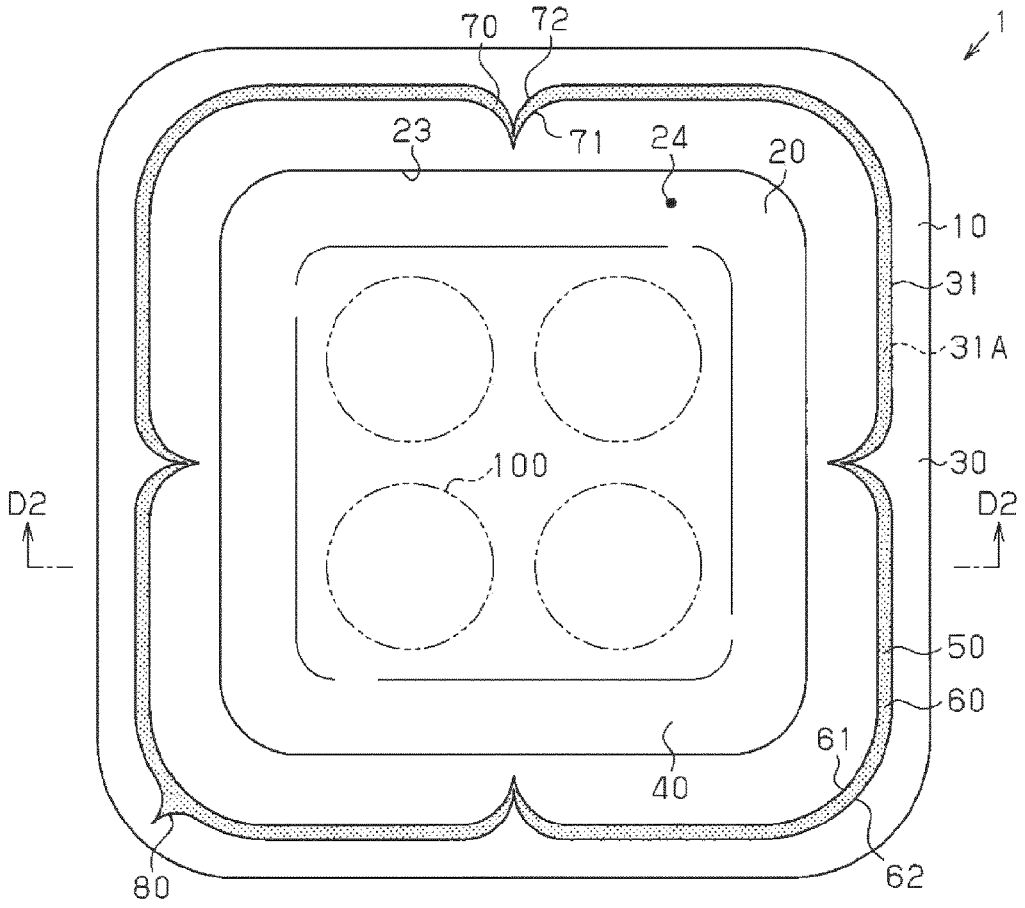
FIG. 1 is a plan view illustrating a package according to an embodiment.

Referring to FIG. 1, hereinafter is described a structure of a package 1.

The package 1 includes, as an example, a tray 10 and a sheet 40.

In a plan view, the tray 10 is in a square shape, which is a representative example. The tray 10 plays a role of accommodating an object 100 to be heated.

The sheet 40 is heat-sealed to the tray 10. The sheet 40 is relatively easily peelable. The sheet 40 has a two-layer structure including an inner layer and an outer layer (both being not shown).

The inner layer is a sealant layer forming a face to be heat-sealed to the tray 10. As an example of a material for the inner layer, a mixed resin can be used. As an example, the mixed resin contains low-density polyethylene and homopropylene. An example of a ratio of the low-density polyethylene contained in the mixed resin is 70 wt %. Another example of a ratio of the homopropylene contained in the mixed resin is 30 wt %. As an example of a material for the outer layer, polyethylene terephthalate can be used. The dots in each of FIGS. 1, 3 and 5 to 7 indicate a seal portion 50 that is a portion where the tray 10 has been heat-sealed to the sheet 40.

Figure 2:
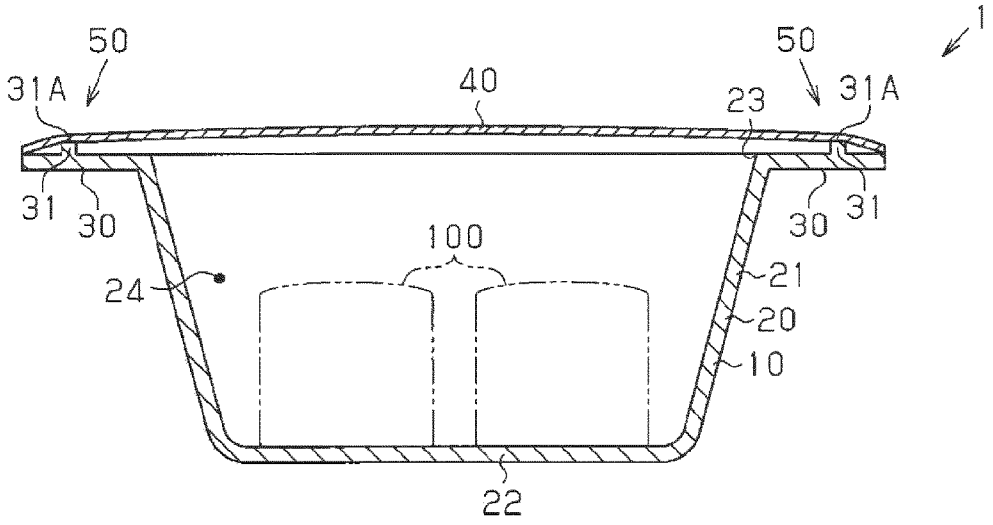
FIG. 2 is a cross-sectional view taken along a line D2-D2 of FIG. 1.

Referring to FIG. 2, a detailed configuration of the tray 10 will be described.

As an example, the tray 10 includes a container 20 and a flange 30. The container 20 and the flange 30 each configure a part of the tray 10 as one object. As an example, the tray 10 is formed by vacuum-forming a mixed resin. As an example, the mixed resin contains polypropylene and talc. The ratio of polypropylene contained in the mixed resin is 70 wt %, for example. The ratio of talc contained in the mixed resin is 30 wt %, for example.

As an example, the container 20 includes a side wall 21, a bottom wall 22 and an opening 23. The side wall 21, the bottom wall 22 and the opening 23 each configure a part of the container 20 as one object. The side wall 21 and the bottom wall 22 form a container space 24. Steamed dumplings (e.g., "shumai"), that is an example of the object 100 to be heated, is placed on the bottom wall 22, for accommodation in the container space 24.

The flange 30 is formed throughout the circumference of an upper outer periphery of the side wall 21 (see FIG. 1). The flange 30 is provided with a seal forming wall 31 which is formed being protruded in a direction opposite to the bottom wall 22. The seal forming wall 31 is formed being extended throughout the circumference of the opening 23. The seal forming wall 31 has a top face 31A which is heat-sealed to the sheet 40 to form the seal portion 50. In other words, the dots in each of FIGS. 1, 3 and 5 to 7 indicate a planar configuration of the top face 31A of the seal forming wall 31.

The seal portion 50 has a sealing force which can be optionally determined. For example, a favorable range of the sealing force of the seal portion 50 is from 1 N/15 mm or more to 10 N/15 mm or less. The sealing force of the seal portion 50 of the package 1 is 5 N/15 mm.

The seal portion 50 includes, as an example, a common portion 60, steam passage portions 70, and an unsealing portion 80. The common portion 60, the steam passage portions 70 and the unsealing portion 80 each configure a part of the seal portion 50 as one object. The common portion 60 is extended along the outer shape of the tray 10. The common portion 60 is formed basically extended throughout the circumference of the flange 30 (see FIG. 1).

The steam passage portions 70 each play a role of externally releasing steam from inside the tray 10. Each steam passage portion 70 is formed at the center of each side of the tray 10. In other words, four steam passage portions 70 are formed in the package 1. The center of each side of the tray 10 should be construed as covering a range that can be substantially taken to be a longitudinal center of each side.

The unsealing portion 80 serves as a cue for user's peeling off the sheet 40 from the tray 10. The unsealing portion 80 is formed by being continued from the common portion 60. The unsealing portion 80 is in a shape protruded from the common portion 60 in a direction opposite to the opening 23.

Figure 3:
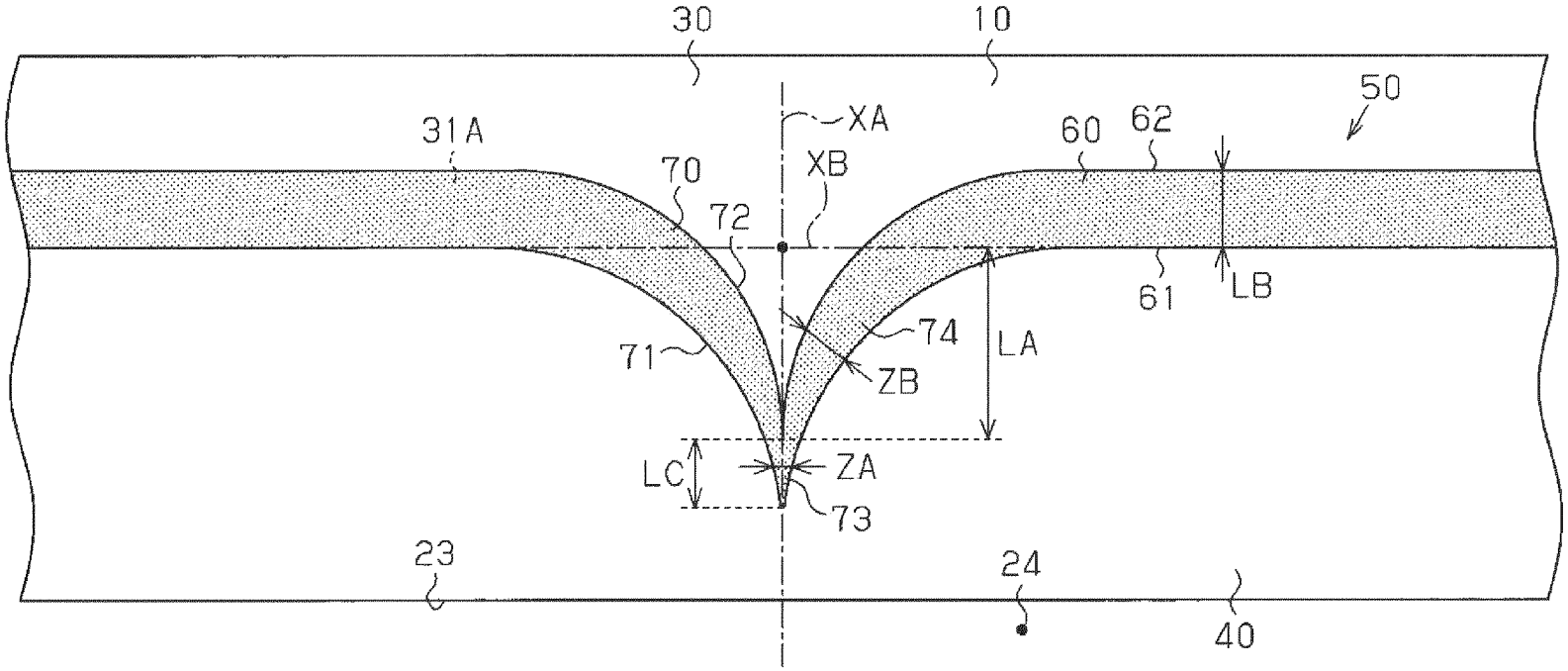
FIG. 3 is an enlarged view of a steam passage portion of the package illustrated in FIG. 1.

Referring to FIG. 3, a shape of the steam passage portion 70 will be described.

Each steam passage portion 70 is an angled portion that is formed being protruded toward the opening 23, and includes an inner edge 71 and an outer edge 72. The inner edge 71 of the steam passage portion 70 is formed by being protruded toward the opening 23, relative to an inner edge 61 of the common portion 60, so as to have an angled shape with a pointed tip. The inner edge 71 of the steam passage portion 70 has a portion configuring one side relative to the tip and a portion configuring the other side relative to the tip, both portions being curved and extended nearing each other toward the tip. The outer edge 72 of the steam passage portion 70 is in a curved shape similar to that of the inner edge 71. In other words, the outer edge 72 of the steam passage portion 70 is formed being protruded toward the opening 23, relative to an outer edge 62 of the common portion 60, so as to have an angled shape with a pointed tip. The curved shape of the outer edge 72 has a curvature radius which is smaller than that of the curved shape of the inner edge 71.

Each steam passage portion 70 includes a merging portion 73 corresponding to a peak of the angled portion. The merging portion 73 is located between the tip of the outer edge 72 and the tip of the inner edge 71. The merging portion 73 has a width ZA which is narrowed from the tip of the outer edge 72 toward the opening 23. The width ZA of the merging portion 73 is in a direction perpendicular to a first line segment XA passing through the tips of the inner and outer edges 71 and 72.

The steam passage portion 70 has a non-merging portion 74 located between the merging portion 73 and the common portion 60. The non-merging portion 74 has a width ZB which is narrowed from the common portion 60 toward the merging portion 73.

The line segment extending from the inner edge 61 of the common portion 60 so as to pass across the first line segment XA is a second line segment XB. The distance between the intersection of the first and second line segments XA and XB and the tip of the outer edge 72 is taken to be a distance LA which is larger than a width (sealing width) LB of the common portion 60.

The distance between the tip of the inner edge 71 and the tip of the outer edge 72 LC is taken to be a distance LC which is smaller than the sealing width LB of the common portion 60. The distance LC can be optionally determined. The distance LC preferably has a range, for example, of about 0.5 mm or more to about 2.0 mm or less. The distance LC of the package 1 is 1.0 mm. The sealing width LB of the common portion 60 coincides with a distance between the inner and outer edges 61 and 62 of the common portion.

Figure 4:
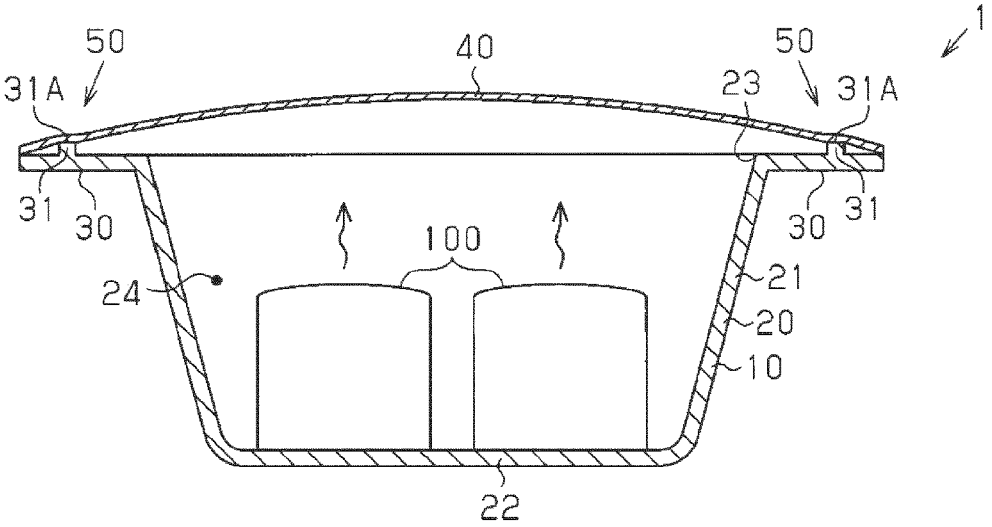
FIG. 4 is a process diagram illustrating a state where the package illustrated in FIG. 1 is being heated by a microwave oven.
Figure 5:
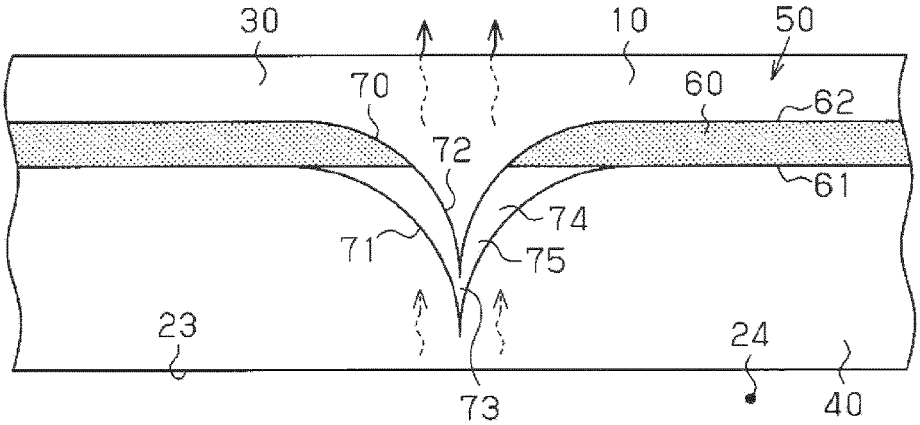
FIG. 5 is a process diagram illustrating a state where the steam passage portion of the package illustrated in FIG. 1 has peeled off.
Figure 6:
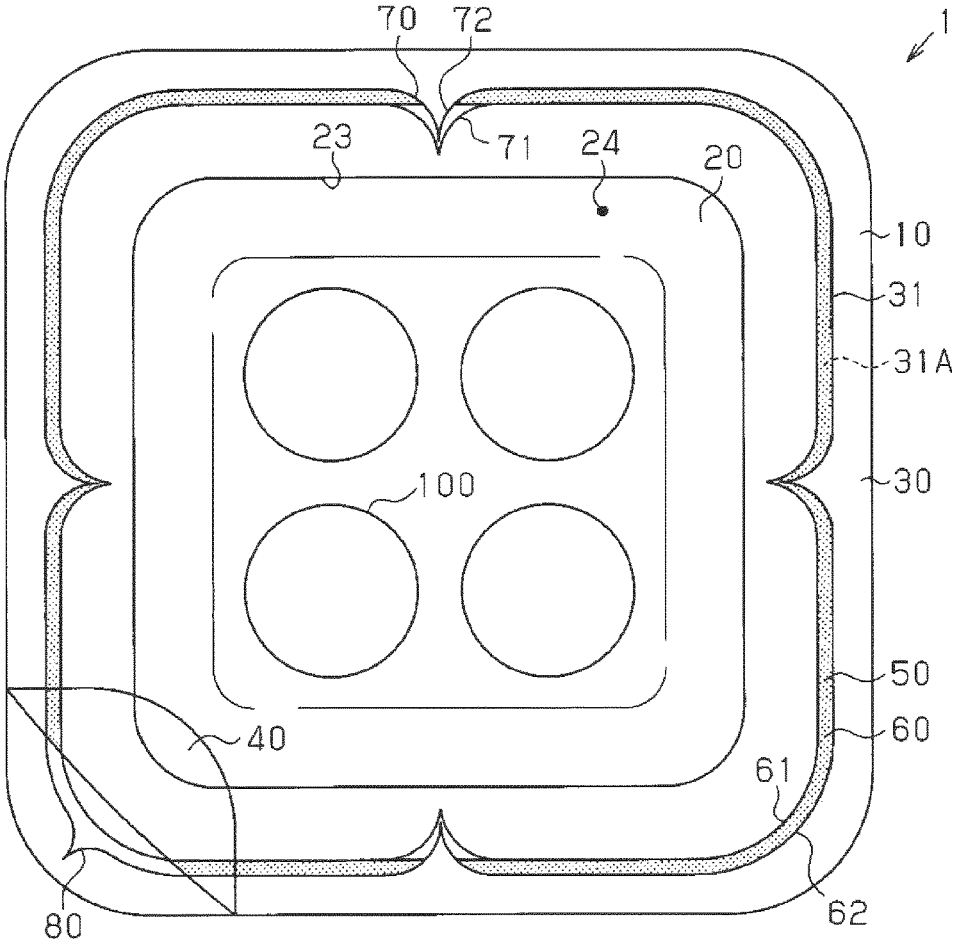
FIG. 6 is a process diagram illustrating a state where the sheet is being peeled off from the tray of the package illustrated in FIG. 1.
Figure 7:
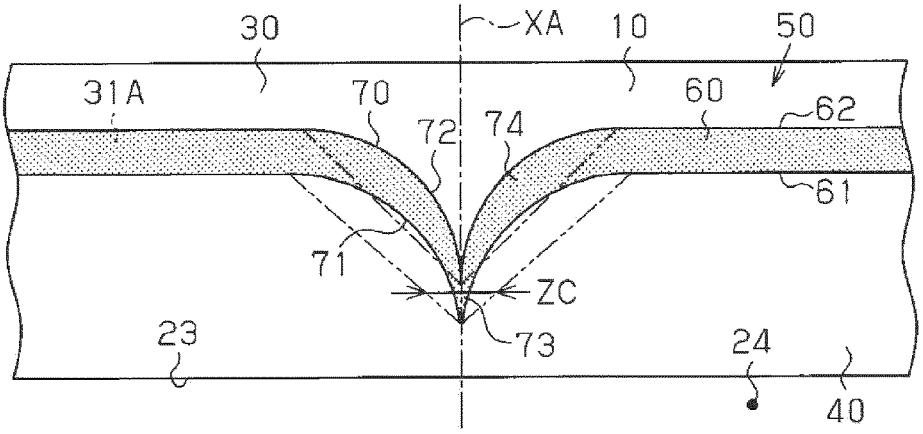
FIG. 7 is a comparison diagram for comparing the steam passage portion of the package illustrated in FIG. 1 with a steam passage portion based on conventional art.

Referring to FIGS. 4 to 6, the usages and advantageous effects of the package 1 will be described.

As an example, a user can heat steamed dumplings (e.g., "shumai"), or the object 100 to be heated, using the package 1 through the following procedure. First, the user can place the package 1, which is occupied by the object 100 to be heated, in a microwave oven that is an example of a heating means.

As shown in FIG. 4, the object 100 to be heated generates steam when the package 1 is heated by the microwave oven. The arrows in FIG. 4 indicate the steam generated from the object 100 to be heated.

Since the opening 23 of the tray 10 is hermetically closed by the sheet 40, the steam generated by the object 100 to be heated stays in the container space 24. As the heating time becomes longer, the inner pressure of the container 24 gradually increases. After increase of the inner pressure of the tray 10, force is likely to be more concentrated on the tip of the inner edge 71 of each steam passage portion 70 and in a portion near the tip in the steam passage portion 70, than in other parts of the seal portion 50. Accordingly, the sheet 40 will peel off from the top face 31A of the tray 10, at the tip and in the vicinity thereof of the inner edge 71 of the steam passage portion 70, earlier than in other parts of the seal portion 50.

As shown in FIG. 5, after the tip of the inner edge 71 of the steam passage portion 70 has peeled off from the tray 10, and with the peel-off portion being used as a cue, peeling of the sheet 40 from the tray 10 progresses in other parts of the steam passage portion 70. Then, when the peeling of the steam passage portion 70 has progressed to the outer edge 72, a steam passage 75 is formed in the steam passage portion 70 to achieve communication between the interior and the exterior of the tray 10. Thus, the steam inside the tray 10 is externally released from the tray 10 via the steam passage 75. When the heating time of the object 100 to be heated has reached a prescribed time, the user can take out the package 1 from the microwave oven.

As shown in FIG. 6, the user can turn over the sheet 40 from the portion where the unsealing portion 80 is formed to peel off the sheet 40 from the tray 10. The user can take out the object 100 to be heated from the tray 10 and eat the object 100 to be heated that has been taken out. FIG. 6 shows, as an example, a structure of the package 1 in plan view in a state where two steam passage portions 70 out of the four steam passage portions 70 have peeled off.

The package 1 can provide the more advantageous effects as set forth below.

(1) According to the package 1, each steam passage portion 70 has the inner edge 71 that includes portions located on both sides relative to the tip of the inner edge 71, and the portions are curved nearing each other. Thus, the width ZA of the merging portion 73 (see FIG. 3) of the steam passage portion 70 becomes smaller, compared to a width ZC of a merging portion of the package of PTL 1 whose inner edge of the steam passage portion is linearly shaped. Therefore, when the inner pressure of the tray 10 has increased, the tip of the inner edge 71 easily peels off in each steam passage portion 70. In this way, much earlier formation of the steam passage 75 can lead to the increase in the amount of steam externally released from the tray 10 via the steam passage 75. Thus, a state where the sheet 40 is excessively pushed up by inflation is unlikely to be created when heated.

(2) According to the package 1, the height of the steam passage portion 70 is larger compared to the case where the distance LA defined between the intersection of the first and second line segments XA and XB and the tip of the outer edge 72 is shorter than the seal width LB of the common portion 60. This can ensure a large passage area in the steam passage 75 which is formed by the peel-off of the steam passage portion 70 from the tray 10. Thus, the amount of steam externally released from the tray 10 via the steam passage 75 is more increased.

(3) According to the package 1, the force of joining the common portion 60 to the tray 10 is larger compared to the case where the seal width LB of the common portion 60 is smaller than the distance LC. Therefore, after each steam passage portion 70 has mostly entirely peeled off from the tray, the common portion 60 is unlikely to peel off from the tray under the conditions where the inner pressure acts on an edge near the steam passage portion 70 in the common portion 60. Accordingly, when heating of the package 1 has been completed, there is likely to be created a state where the steam passage portions 70 are peeling off while the common portion 60 has not substantially peeled off. With the package 1 in this state, particularly high-temperature portions due to the passage of steam are limited to the steam passage portions 70 and their vicinities. Thus, the user, when he/she holds the tray 10, is unlikely to be in contact with the high-temperature portions.

(4) The inventor of the present invention conducted a first confirmation test to confirm a relationship between the distance LC and the tendency of peel-off due to the increase of the inner pressure. The inventor also conducted a second confirmation test to confirm a relationship between the distance LC and the tendency of peel-off of the steam passage portions 70 due to falling of the package 1. In the tests, the inventor used several objects to be heated which were expected to be generally used as the objects 100 to be heated to confirm the tendency of peel-off of the steam passage portions 70 due to the increase of the inner pressure, and the tendency of peel-off of the steam passage portions 70 due to falling of the package 1.

The first and second confirmation tests were conducted by fixing the curvature radius of the curve of each of the inner and outer edges 71 and 72 of the steam passage portions 70 and changing the distance LC.

The results of the first confirmation test showed that when the distance LC was 2 mm or less, the time taken for forming the steam passage 75 after start of heating of the package 1 was shorter than the time generally taken for heating the package 1. Accordingly, the steam passage portions 70 appropriately peeled off while the package 1 was heated to thereby form the steam passages 75.

The results of the second confirmation test showed that when the distance LC was about 0.5 mm or more, the steam passage portions 70 were unlikely to peel off from the tray 10 if the package 1 fell and the impact force impinged on the package 1 while being transported, for example. The second confirmation test was conducted several times, with the falling distance of the package 1 being changed within the height of ordinary persons.

(5) In the tray 10 in a square shape, the sheet is pushed up from the center of the tray 10, forming a shape similar to a hemispherical shape by the inflation due to the increase of the inner pressure of the tray 10. Accordingly, the force for peeling the seal portion 50 is likely to be concentrated near the center of each side of the square tray 10, of which the distance from the center of the tray 10 is the shortest.

In the package 1, since each steam passage portion is formed at the center of each side of the tray 10, the force of peeling the seal portion 50 is easily concentrated on the portion. Accordingly, the heat passage portion 70 easily peels off and thus the steam inside the tray 10 is more easily released outside.

The mode that the present package can specifically have is not limited to the one shown in the above embodiment. The present package can be in various modes different from the one shown in the above embodiment. The following modifications of the above embodiment are only examples of the various modes that the present package can have.

In a package according to a modification, the seal forming wall 31 is omitted. In a package of this modification, the flange 30 is heat-sealed to the sheet 40 via a seal bar. The seal bar has a sealing face which is in a shape identical with that of the seal portion 50.

In a package according to a modification, the seal portion 50 is provided with one to three or five or more steam passage portions 70.

In a package according to a modification, the steam passage portion 70 is formed in the top face 31A so as to be located in a portion other than the center of each side of the tray 10.

In a package according to a modification, the distance LC is larger than at least one of the distance LA and the seal width LB.

In a package according to a modification, the distance LA is smaller than the seal width LB.

In a package according to a modification, the tray 10 in plan view is in a circular or polygonal shape.

In a package according to a modification, the object 100 to be heated is different from the one in the embodiment. As an example, the package 1 is used for heating food other than steamed dumplings (e.g., "shumai") that is the object 100 to be heated. According to another modification, the package 1 is used for heating a baby's bottle and water as the object 100 to be heated. In this case, the steam of the water thermally sterilizes the baby's bottle.

What is claimed is:

1. A package comprising:

a tray having an opening and a top face extended around the opening; and a sheet sealed to the top face to hermetically close the opening, with the sheet being sealed to the top face to form a seal portion that has a common portion extended along an outer shape of the tray and a steam passage portion externally releasing steam from inside the tray;

wherein the steam passage portion has an inner edge protruded from an inner edge of the common portion toward the opening so as to have an angled shape with a pointed tip, the inner edge of the steam passage portion having a portion configuring one side relative to the tip and a portion configuring another side relative to the tip, the both portions configuring the sides being curved and extended nearing each other toward the tip;

wherein the steam passage portion has an outer edge in a curved shape with a pointed tip; the curved shape of the outer edge corresponding in profile to a curved shape of the inner edge of the steam passage portion; and wherein the steam passage portion includes a merging portion corresponding to a peak of the angled shape and located between the tip of the outer edge and the tip of the inner edge, and a non-merging portion located between the merging portion and the common portion, the non-merging portion having a width narrowed from the common portion toward the merging portion.

2. The package of claim 1, wherein:

a first line segment is defined as passing through the tip of the inner edge of the steam passage portion and the tip of the outer edge;

a second line segment is defined as being extended from the inner edge of the common portion and passing across the first line segment; and a distance from an intersection of the first and second line segments to the tip of the outer edge is larger than a width of the common portion.

3. The package of claim 1, wherein a width of the common portion is larger than a distance between the tips of the inner and outer edges.

4. The package of claim 1, wherein an extent of the steam passage portion between tips of the inner and outer edges is within a range from about 0.5 mm to about 2 mm.

5. The package of claim 2, wherein:

the tray comprises a rectilinear portion; and the package further comprises a plurality of steam passage portions arranged such that each side of the rectilinear portion includes one of the steam passage portions.

6. The package of claim 3, wherein:

the tray comprises a rectilinear portion; and the package further comprises a plurality of steam passage portions arranged such that each side of the rectilinear portion includes one of the steam passage portions.

* * * * *